United States Patent [19]

Matsumoto et al.

[11] 4,254,576

[45] Mar. 10, 1981

[54] SPIN TOWER STATION FOR USE WITH TOY VEHICLE AND TRACKWAY

[75] Inventors: Hajime Matsumoto, Chiba; Toshio Suzuki, Tokyo, both of Japan

[73] Assignee: Toybox Corporation, Japan

[21] Appl. No.: 31,139

[22] Filed: Apr. 18, 1979

[51] Int. Cl.[3] ..... A63H 19/10

[52] U.S. Cl. ..... 46/216; 46/257

[58] Field of Search ..... 46/216, 257, 202, 206; 104/147 A, DIG. 1; 46/135 R, 116, 119

[56] References Cited

U.S. PATENT DOCUMENTS

| | | | |
|---|---|---|---|
| 3,456,382 | 7/1969 | Einfalt | 46/202 |
| 3,483,653 | 12/1969 | Genin | 46/202 |
| 3,908,989 | 9/1975 | Meyer | 46/206 |
| 4,068,402 | 1/1978 | Tawaka | 46/216 |
| 4,109,412 | 8/1978 | Saito | 46/216 |

*Primary Examiner*—Robert A. Hafer
*Attorney, Agent, or Firm*—Staas & Halsey

[57] ABSTRACT

A spin tower station for use with a toy vehicle and a trackway network connecting a plurality of stations, each with its own unique amusement function. The spin tower station, which receives a vehicle at a station entry port and simultaneously moves it translationally and rotationally to a station exit port positioned below, includes a base, two telescoping cylindrical elements extending upward from the base, a vehicle platform mounted on the upper element and normally positioned at the entry port by a spring mounted within the lower element, and a spiral flange on the upper element which engages a stationary guide notch to rotate the upper element as it descends against the force of the spring under the weight of a vehicle on the platform. After the vehicle departs the exit port, the spring forces the platform upward to await the return trip of the vehicle.

17 Claims, 5 Drawing Figures

SPIN TOWER STATION FOR USE WITH TOY VEHICLE AND TRACKWAY

BACKGROUND OF THE INVENTION

The present invention relates to toy vehicular systems, and in particular to a spin tower station which can be used with a toy vehicle and trackway.

Toy vehicles which run on closed track systems are well known amusement devices. The repetitive vehicular movements frequently encountered in such amusement devices, however, can frequently become boring. Accordingly, a number of techniques have been used for extending the usefulness of such toys by providing a degree of variety to stave off the ultimate onslaught of boredom. Unfortunately many such techniques are complicated or expensive, as can be verified by anyone who has ever witnessed a model railway system which has expanded to take over an entire room and depleted the pocketbook of its owner.

One toy vehicle and trackway system which inexpensively provides a marked degree of variety is disclosed in U.S. Pat. No. 4,068,402, the subject matter of which is incorporated herein by reference. As is discussed in more detail hereafter, this patent discloses an amusement device having several "stations" connected by vechicle conduits such as descending sections of trackway. A toy vehicle having a miniature electric motor with a gearing arrangement to rotate two gear wheels extending from either side of the vehicular chassis is used in the amusement device disclosed in U.S. Pat. No. 4,068,402. The driving arrangement for such toy vechicles is well known in the art.

SUMMARY OF THE INVENTION

Despite the market place's enthusiastic reaction to the amusement device disclosed in U.S. Pat. No. 4,068,402, it would be desirable to provide a toy vehicle and trackway system which can command a child's attention longer by providing still more variety. Accordingly, one object of the present invention is to provide an additional station which is compatible with and not redundant with respect to the stations disclosed in U.S. Pat. No. 4,068,402.

Another object of the present invention is to provide a station having an entry port for receiving vehicles traveling in a first direction at a first elevation, and an exit port for releasing the vehicle at a second elevation for further travel in a second direction.

Still another object of the present invention is to provide a spin tower station having a station entry port and an awaiting platform which is biased upward by a spring, and which is provided with a mechanism for simultaneously rotating the platform and moving it translationly in response to the weight of a vehicle on the platform, the combined rotational and translational movements being selected to align the vehicle with the awaiting trackway section at the station exit port.

DESCRIPTION OF THE PREFERRED EMBODIMENT

Figure 1:
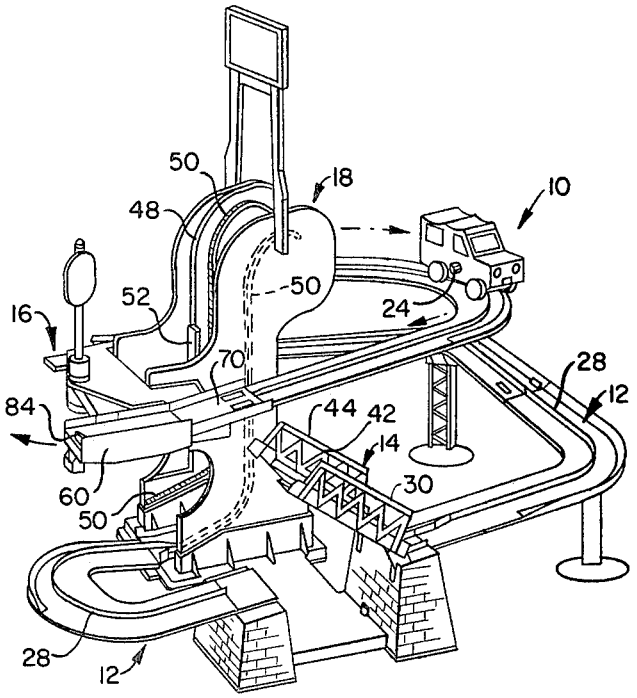
FIG. 1. PRIOR ART
FIG. 1 is a perspective view of an earlier toy vehicle and trackway, which is the subject of U.S. Pat. No. 4,068,402, illustrating generally the motion of a wheeled vehicle on sections of trackway connecting a rotating carrier station, a bridge station, and a somersault tower station.

The spin tower station of the present invention can be adventageously employed with a toy vehicle and trackway of the type disclosed in U.S. Pat. No. 4,068,402. With reference to FIG. 1, such an amusement device may include trackway sections 12 interconnecting bridge station 14, rotating carrier station 16, and somersault tower station 18. As is illustrated in FIG. 1 the entire trackway-and-station assembly presents a downward sloping circuitous path leading from the top or exit port of somersault tower station 18 to the bottom or entry port of somersault station 18, with portions of the trackway 12 being vertically spaced apart to accomodate the downward slope. A vehicle 10 placed in the position illustrated in FIG. 1 will coast downward on its freely rotatable wheels under the influence of gravity, guided by upstanding rail 28 protruding from trackway 12, until it encounters the entry port of rotating carrier station 16. The exterior configuration of vehicle 10 can take different forms, such as the configurations illustrated in phantom in FIGS. 2 and 3. The vehicle 10 then enters movable carrier 60, which is spring biased in the position illustrated. Movable abutment 84 retains the vehicle 10 within carrier 60, but the momentum of vehicle 10 causes carrier 60 and the vehicle supported thereon to rotate against the biasing force until abutment 84 is activated at the exit port of rotating carrier station 16 and releases vehicle 10 to continue its downward journey. The biasing force returns carrier 60 to its previous position to await the next encounter with the vehicle 10. After leaving the exit port of station 16, trackway 12 carries vehicle 10 to the entry port of the bridge station 14. Movable bridge 30, which is spring biased in the position illustrated in FIG. 1, is provided with rails 42 having continuous racks of teeth 44 on the top thereof. It will be apparent that power driven gear wheels 24 (it being noted that a second gear wheel 24 is positioned on the side of vehicle 10 not illustrated in FIG. 1) are positioned to engage racks of teeth 44 and slowly draw vehicle 10 into bridge station 14. As vehicle 10 advances into station 16 its weight forces bridge 30 downward against the biasing force until vehicle 10 resumes its journey on trackway 12 after leaving the exit port of station 14. Upon encountering the entry port of somersault tower station 18, powered gear wheels 24 mesh with continuous racks of teeth 50 and draw vehicle 10 slowly upward, it being noted that rails 48 are provided to keep gear wheels 24 in engagement with racks of teeth 50 during the ascent. An abbreviated rack of teeth 52 is provided at one side of somersault tower station 18 to engage a stationary gear wheel 26 (not shown), which is mounted concentric to the gear wheel 24 on the side of vehicle 10 not visible in FIG. 1, to slowly rotate or "somersault" vehicle 10 during a portion of the assent to the exit port of station 18. After leaving the exit port vehicle 10 begins another downward trip.

Figure 2:
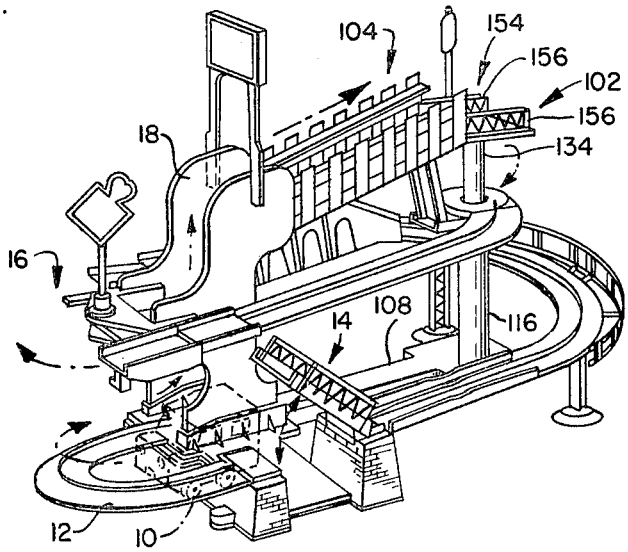
FIG. 2 is a perspective view of a toy vehicle and trackway system incorporating the spin tower station of the present invention, illustrating generally the combined rotational and translational movement of the vehicle produced by the new station, in addition to the complimentary movements generated by known stations.

The spin tower station 102 of the present invention is illustrated in FIG. 2 as part of a toy vehicle and trackway amusement device of the type previously discussed, it being noted that ascending ramp 104 having racks of teeth 106 (not shown) suitably positioned to engage powered gear wheels 24 on vehicle 10 has been added to receive vehicle 10 from the exit port of somersault tower station 18 and deliver it to the entry port of spin tower station 102.

Figure 3:
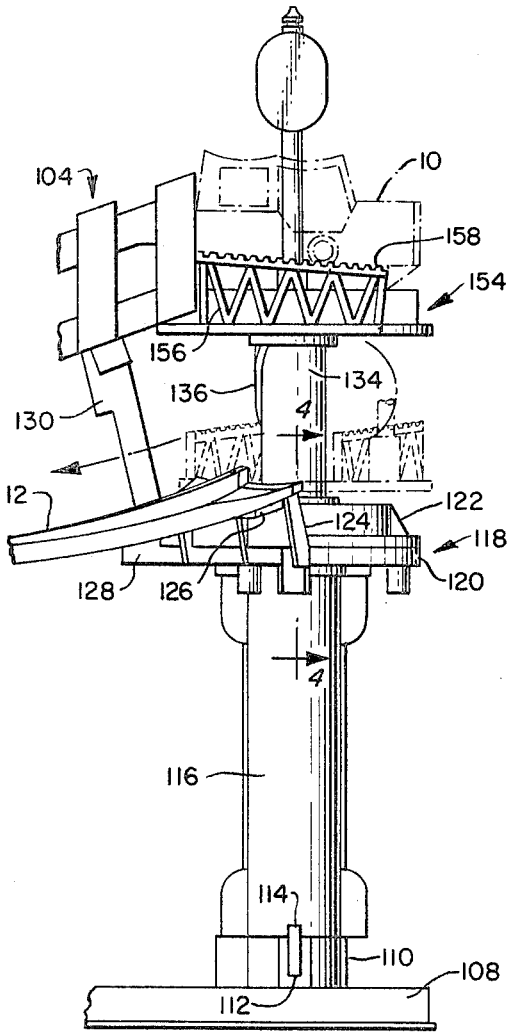
FIG. 3 is a side view of the spin tower station, illustrating the position of the platform before it is forced downward by the weight of the toy vehicle, the position of the platform after the vehicle has undergone rotational and translational movement, and the motion of the toy vehicle as it departs the spin tower.

As is illustrated in FIG. 3, station 102 is provided with a base 108 which is advantageously constructed for connection with the base members of the remaining stations so that the various stations may be interlocked to increase the sturdiness of the entire assembly. Molded upon the plastic forming base 108 is support 110, which is provided with notch 112 for receiving tongue 114 pertruding from cylindrical column 116 so as to ensure that column 116 has the proper angular orientation with respect to base 108 when column 116 is inserted into support 110. Support 118 having first element 120 and second element 122 is fixedly mounted at the top of column 116, first element 120 being provided with member 124 having tongue 126 for receiving and supporting the section of trackway 12 leading from the exit port of station 102, and with member 128 for receiving and supporting element 130, which is pivotably attached to the underside of ramp 104, to support the end of ramps 104 adjacent the entry port of station 102.

Figure 4:
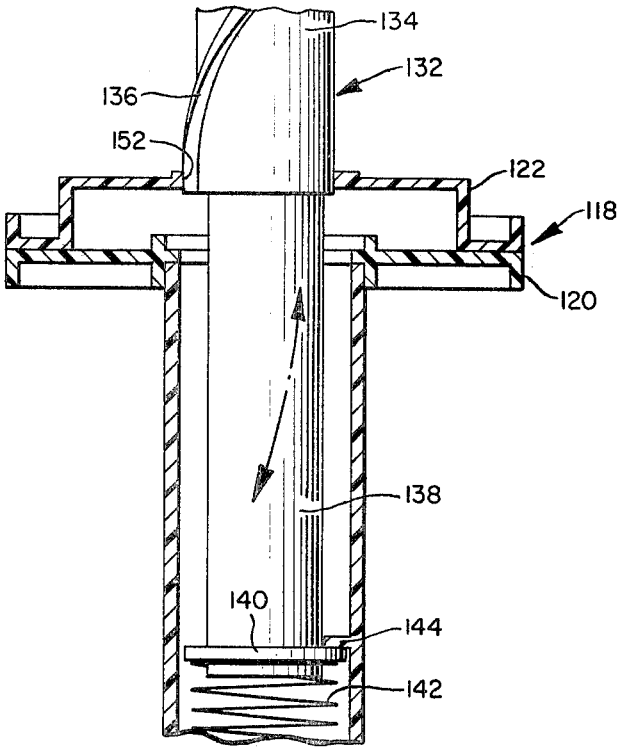
FIG. 4 is a sectional view taken along the line 4—4 of FIG. 3, illustrating generally the spiral flange which cooperates with a guide notch to produce rotational movement as the weight of the toy vehicle compresses a biasing spring.
Figure 5:
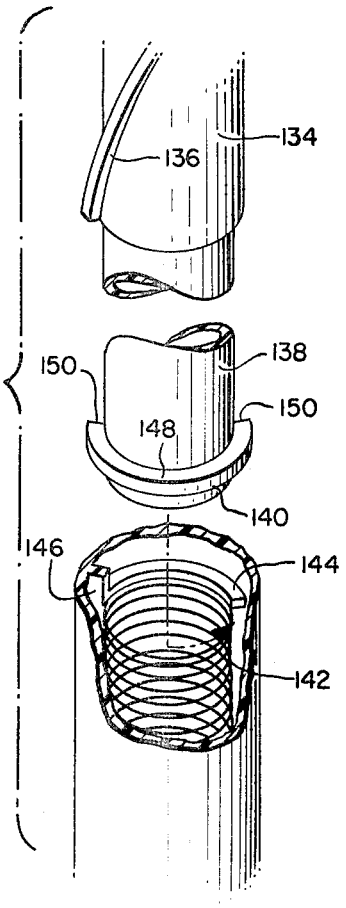
FIG. 5 is a exploded perspective view of part of the mechanism illustrated in FIG. 4.

With reference now to FIGS. 4 and 5, member 132 is provided with upper cylindrical column 134 having sprial flange 136 affixed thereto, and lower cylindrical column 138 on which arcuate collar 140 is affixed. Column 116 is hollow to accommodate columns 134 and 138, which are biased upward within column 116 by spring 142 extending between the base 146 (not shown) of column 116 and collar 140. It will be apparent to those skilled in the art that ribs 144 and 146 affixed to the inside of column 116 limit the verticle movement of member 132 by impinging upon the upper surface 148 and end portions 150 of collar 140.

With continuing reference to FIG. 4, second element 122 is provided with guide notch 152 to accomodate sprial flange 136. It will be apparent to those skilled in the art that the interaction of flange 136 and notch 152 will impart a rotational movement to member 132 when column 134 is inserted into or withdrawn from column 116.

With now reference to FIGS. 2 and 3, platform 154 is affixed to the top of upper cylindrical column 134. Parallel rails 156 having continuous racks of teeth 158 on the top thereof are mounted on platform 154 and oriented to align with ramp 104 when member 132 is in its uppermost position, that is, when collar 140 abuts rib 144. It will be apparent to those skilled in the art that when vehicle 10 exits ramp 104, the rotating gear wheels 24 will engage racks of teeth 158 and draw vehicle 10 forward until it no longers receives support from ramp 104. The weight of vehicle 10 on platform 154 will force member 132 downward against the biasing force of spring 142, until the bottom of platform 154 rests on the upper surface of element 122. The distance of this translational movement is selected to that the simultaneous translational and rotational movement will align rails 156 with the trackway section 12 leading from station 102, as illustrated in phantom lines in FIG. 3. Further rotation of gear wheels 24 will move vehicle 10 off platform 154 and onto trackway 12, so that vehicle 10 can continue to the next station.

With final reference to FIG. 2, the operation of the spin tower station of the present invention can now be described in conjunction with a toy vehicle and trackway amusement device. With the vehicle positioned as shown in phantom lines in FIG. 2, descending trackway 12 will lead it to the entry port of somersault tower 18, whereupon the vehicle will be raised in the manner previously described to the exit port of station 18 and thence, by the continuing rotation of gear wheels 24, up ramp 104. Ramp 104 delivers the vehicle at the entry port of station 102, and continued rotation of gear wheels 24 draws the vehicle entirely onto platform 154. At this point the weight of the vehicle produces the combination of translational and rotational movements previously described, to deliver the vehicle at the exit port of station 102 so that it can continue down trackway 12. It is apparent that station 102 receives the vehicle at a first height above base 108 and traveling in a first direction, and delivers the vehicle at a second height above base 108 so that it can travel in a different direction. Following the vehicle's exit from station 102, gravity leads it to station 16 and then to station 14. Thereafter the cycle begins again for the repeated amusement of the child.

Although the spin tower station of the present invention has been described with specific reference to the toy vehicle and trackway of U.S. Pat. No. 4,068,402, it is apparent that it could be advantageously employed in amusement devices having other combinations of stations and trackway sections.

I claim:

1. An amusement device, comprising:

a vehicle provided with wheels freely mounted for rotation, first driven gears mounted for rotation, and a second stationary gear mounted concentrically with respect to one of said first gears; and a trackway against which said wheels of said vehicle rest, said trackway being provided with guide means for directing said vehicle therealong and including:

a somersault tower station having an entry port positioned below and exit port, said somersault tower station including upstanding side portions provided with first continuous racks of teeth positioned to be engaged by said first driven gears of said vehicle to propel said vehicle upwardly along said side portions of said tower station, one of said side portions also being provided with a second rack of teeth spaced apart from said first rack and positioned to be engaged by said second stationary gear of said vehicle to cause said vehicle to rotate about said second gear simultaneously while moving upwardly along said side portions of said tower, a spin tower station having an entry port positioned above an exit port, said spin tower station including a platform with parallel rails having racks of teeth thereon positioned to engage said first driven gears of said vehicle, and first means mounting said platform for moving said platform downward from said entry port to said exit port while simultaneously rotating said platform about the axis of the downward movement, second means for conveying said toy vehicle from said exit port of said spin tower station to said entry port of said somersault tower station, and third means for conveying said toy vehicle from said exit port of said somersault tower station to said entry port of said spin tower station.

2. The amusement device of claim 1, wherein said first means comprises:

a base;

a first hollow element extending upward from said base;

a second element moveably extending into the interior of said first element, said platform being mounted on top of said second element;

spring means for biasing said second element away from said base;

a spiral flange mounted on said second element; and a support mounted on said first element, said support having an opening therein through which said second element extends and a guide notch extending from said opening, said spiral flange extending into said guide notch to exert a torque on said second element as said second element moves downward within said first element against the force of said spring means when said vehicle is supported on said platform.

3. The amusement device of claim 2, wherein said second means includes a rotating carrier station having an entry port and an exit port at substantially the same elevation, comprising:

a carrier for said vehicle, means mounting said carrier to rotate between positions adjacent to said entry and exit ports of said rotating carrier station;

spring means normally urging said carrier into a position adjacent to said entry port of said rotating carrier station such that as said vehicle moves into said entry port of said rotating carrier station and enters said carrier, said vehicle and said carrier are rotated to a position adjacent to said exit port of said rotating carrier station at which time said vehicle leaves said carrier;

fourth means for conveying said vehicle from said exit port of said spin tower station to said entry port of said rotating carrier station; and fifth means for conveying said vehicle from the exit port of said rotating carrier station to said entry port of said somersault tower station.

4. The amusement device of claim 3, wherein said fifth means includes a bridge station having an entry port positioned above an exit port, comprising:

a base;

a bridge having a free end and one end pivotably mounted to said base;

parallel rails mounted in said bridge, said rails having racks of teeth thereon positioned to engage said first driven gears; and spring means cooperating with said bridge and base for normally biasing the free end of said bridge upward until said vehicle moves into said entry port and proceeds across said bridge thereby lowering said bridge against the force of said spring means to allow said vehicle to progress to said exit port.

5. The amusement device of claim 4, wherein the exit port of said spin tower station is higher than the entry port of said rotating carrier station and is connected thereto by a downward sloping section of trackway, wherein the exit port of said rotating carrier station is higher than the entry port of said bridge station and is conducted thereto by sixth means for conveying said vehicle between the exit port of said rotating carrier station and the entry port of said bridge station, said sixth means including a downward sloping section of trackway, and wherein the exit port of said bridge station is higher than the entry port of said somersault tower station and is connected thereto by a downward sloping section of trackway.

6. The amusement device of claim 5, wherein the exit port of said somersault tower station is lower than the entry port of said spin tower station and is connected thereto by an ascending ramp having parallel rails with racks of teeth thereon positioned to engage said first driven wheels of said toy vehicle.

7. An amusement device of the type including a plurality of stations connected by conduits of changing elevation for conducting a toy vehicle between stations, wherein the improvement comprises:

spin tower station means for receiving a toy vehicle from a conduit at a first elevation and conveying said vehicle downward to a conduit at a second elevation while simultaneously rotating said vehicle about the axis of the downward movement, said spin tower station means including:

a base;

a first element having an opening therein and an elongated internal cavity extending from said opening, the axis of said elongated internal cavity being substantially vertical;

a second elongated element movably extending into the opening of said first element;

a platform mounted at the top of said second element;

spring means for biasing said platform away from said base; and first means mounted on said first and second elements for rotating said second element when said platform is moved downward against the biasing force of said spring means.

8. The amusement device of claim 7, wherein said first means comprises a support mounted on said first element, said support having an opening therein through which said second element moves and a guide notch extending from said opening in said support, and a spiral flange mounted on said second element and engaging said guide notch.

9. The amusement device of claim 8, wherein said base comprises second means for securly attaching said spin tower station means to at least one other station.

10. The amusement device of claim 9, wherein the top of said support is positioned to support said platform when said platform is substantially at said second elevation, and further comprising third means mounted in said elongated internal cavity and cooperating with said second element for limiting the upward movement of said platform at substantially said first elevation.

11. The amusement device of claim 10, further comprising fourth means mounted on said support for supporting an incoming conduit leading to said platform when it is substantially at said first elevation, and fifth means mounted on said support for supporting an outgoing conduit leading from said platform when it is substantially at said second elevation, the angle determined by said fourth means, said second element, and said fifth means substantially corresponding to 360° minus the angle through which said vehicle is rotated when said platform moves from said first to said second elevation.

12. A spin tower station for receiving a toy vehicle traveling in a first direction at a first elevation and for releasing said toy vehicle for further travel in a second direction at a second elevation, comprising;

a first hollow element having first and second ends;

a second element having first and second ends, said second element movably extending into the interior portion of said first element with the second end of the said second element facing the second end of said first element;

a platform mounted on the first end of said second element;

spring means for forcing the second end of said second element away from the second end of said first element;

retainer means mounted on said first element and cooperating with said second element for preventing further movement of said second element away from said first element after said platform has attained a position substantially equivalent to said first elevation;

a support mounted at the first end of said firse element and having an opening therein through which said second element passes, the upper surface of said support being positioned to contact said platform when said platform has attained a position substantially equivalent to said second elevation, and;

first means cooperating with said support and said second element for rotating said platform through a predetermined angle during movement of said platform between said first and second elevations.

13. The station of claim 12, wherein said support has a guide notch therein and wherein said first means comprises a spiral flange on said second element, said spiral flange engaging said guide notch.

14. The station of claim 13, further comprising a pair of parallel rails affixed to said platform and spaced from each other a distance wider than the width of said toy vehicle, the axis of said rails being substantially parallel to said first direction when said platform is substantially positioned at said first elevation.

15. The station of claim 14, wherein said vehicle has a power-driven gear wheel extending from either side thereof and wherein each of said parallel rails is provided at the top thereof with a continuous rack of teeth positioned to engage said gear wheels.

16. The station of claim 15, further comprising second means mounted on said support for securing support for a conduit leading to said platform when said platform is positioned substantially at said first elevation, and third means mounted on said support for supporting a conduit leading from said platform when said platform is positioned substantially at said second elevation.

17. The station of claim 16, wherein said spring means comprises a spring positioned within said first element and extending from the second end of said second element to the second end of said first element.

* * * * *